United States Patent [19]

Morgan

[11] Patent Number: 4,929,213

[45] Date of Patent: May 29, 1990

[54] FLEXIBLE FOAM PICTURES

[76] Inventor: Richard H. Morgan, 134 S. Gain St., Anaheim, Calif. 92804

[21] Appl. No.: 371,625

[22] Filed: Jun. 26, 1989

[51] Int. Cl.[5] ..... A63H 3/16; A63H 3/02; A63H 3/36; B41M 3/12

[52] U.S. Cl. ..... 446/97; 446/385; 446/369; 428/914; 428/318.4; 428/200

[58] Field of Search ..... 446/97, 98, 99, 100, 446/391, 385, 387, 369; 428/914, 318.4, 195, 200; 40/538, 160, 154, 152

[56] References Cited

U.S. PATENT DOCUMENTS

| | | | |
|---|---|---|---|
| 833,448 | 10/1906 | De Vall et al. | 430/496 |
| 2,170,971 | 8/1939 | Lodewick et al. | 446/391 X |
| 2,199,049 | 4/1940 | Greenberg | 446/391 |
| 2,369,031 | 2/1945 | Engle | 446/387 |
| 2,468,731 | 5/1949 | Borkland | 446/391 X |
| 2,684,104 | 7/1954 | Dessart et al. | 446/391 X |
| 3,026,648 | 3/1962 | Lemelson | 446/391 X |
| 3,354,578 | 11/1967 | Ryan | 446/369 |
| 3,553,062 | 1/1971 | Berlin | 40/160 X |
| 3,758,358 | 9/1973 | Kuroda | 40/160 |
| 3,920,499 | 11/1975 | Day et al. | 428/200 X |
| 4,020,586 | 5/1977 | Benner | 446/391 |
| 4,284,398 | 8/1981 | Bokelmann | 273/58 R X |
| 4,648,188 | 3/1987 | Blair | 40/538 |
| 4,659,319 | 4/1987 | Blair | 446/391 X |

FOREIGN PATENT DOCUMENTS

| | | | |
|---|---|---|---|
| 22825 | of 1909 | United Kingdom | 446/391 |
| 2013508 | 8/1979 | United Kingdom | 446/100 |

*Primary Examiner*—Robert A. Hafer
*Assistant Examiner*—D. Neal Muir

[57] ABSTRACT

A method of creating images, such as the face of a child, on flexible foam plastic, such as a doll's head. The method can also be used to create realistic images of other objects such as pet animals, with the head on a separate piece of foam attachable to the body in different tilted positions by means of Velcro. Existing technology is used to make the type of thermal transfer which obtains its color from deposits of colored wax. This is then brought into register with bumps and hollows on the flexible foam blank, and the blank flattened by mechanical pressure during the transferring step. After completion, the resilience of the flexible foam blank recreates a three dimensional surface; hence, the final product is more representative of the object than was the transfer from which it was made.

4 Claims, 1 Drawing Sheet

FLEXIBLE FOAM PICTURES

BACKGROUND OF THE INVENTION

1. Field of the Invention

Several fields are touched by my invention of a method to create full color images on soft foam plastic surfaces. The field of children's dolls is considered the principal one, in that the faces of living persons can be faithfully reproduced on the doll. The method can also be used to create busts, including busts with moveable parts, suitable for children's playthings or to replace photographs wherever adults display photographs, thus it has application to the field of sculpture and photography. Being soft, the product of this method is suitable for use in the field of ornaments attached to the rear-view mirror or windows of automobiles.

2. Description of Prior Art

As early as 1906 DeVall et al (U.S. Pat. No. 833,448) recognized that doll faces resembling living persons would have appeal. DeVall applied sensitized photographic film to the face area of a doll and, placing the doll in a camera, somehow obtained a positive print of the subject's face on the doll. Benner (U.S. Pat. No. 4,020,586) and Greenberg (U.S. Pat. No.2,199,049) placed a flat photograph on a doll's face. Blair (U.S. Pat. No. 4,648,188) first sculpted the facial contours, then stretched a flat photograph with backing removed, over the contoured face area of a doll. Later Blair (U.S. Pat. No. 4,659,319) placed a flat photograph, the image being on fabric, vinyl sheet, or paper on a thick hollow shell of clay-like material, and molded the face by inserting one hand into the hollow interior while pressing on the photograph. This method gave direct guidance to the sculptor/modeler to expedite formation of the clay, which was later baked to harden. An alternate method described by Blair to make a soft head doll was by stuffing behind the photograph or stitching through it.

SUMMARY OF THE INVENTION

My invention, in the preferred embodiment, takes advantage of the extreme flexibility of a block of plastic foam to reverse the effects of photography. A photograph creates a flat, two dimensional image of objects such as people's heads which are three dimensional. By converting the photograph to a thermal transfer of the type in which colored wax is deposited on the surface of the flat transfer itself, then placing the transfer on a block of foam which has a three dimensional surface, squeezing the foam flat at the same time heat is applied to cause the wax to migrate to the porous surface of the foam, and releasing the pressure of the squeeze so the contact surface of the foam returns to a three dimensional shape, the colored image of the object on the foam assumes three dimensional characteristics, approximating the original object more closely than a photograph can ever do.

For making dolls heads in the likeness of, say, the child who owns them, this method overcomes the problems of face-flatness, applying photographic emulsion to the face area and keeping it from being exposed prematurely, and sculpturing skill and cost which are drawbacks to the methods used in the prior art.

My method also can be used to place images on flat foam surfaces. In that case, as the imprinted block of foam remains flexible, the resulting product will be more resistant to causing or sustaining damage during use than were the image created on hard, solid material or laminated thereto.

DETAILED DESCRIPTION

Figure 1:
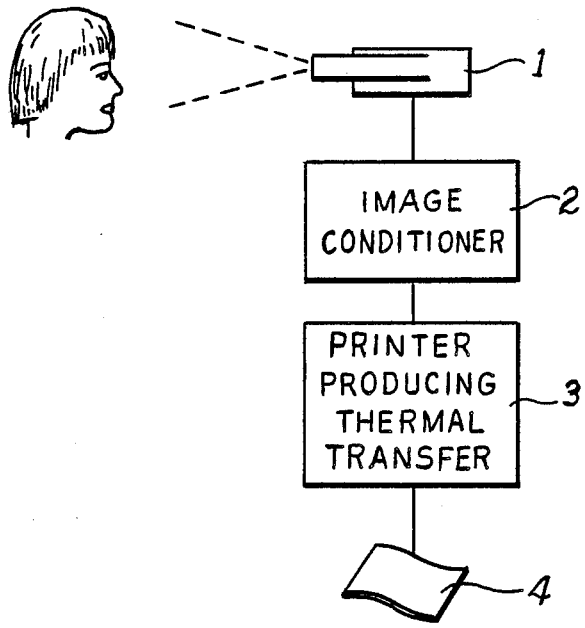
FIG. 1 shows the sequential steps used in producing a thermal transfer of the type required.
Figure 6:
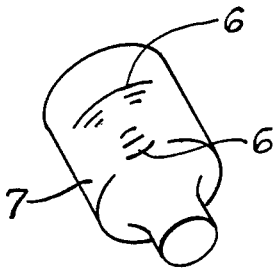
FIG. 6 shows in perspective a foam blank contoured to receive a transfer.
Figure 2:
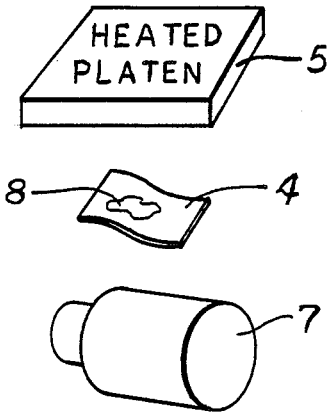
FIG. 2 is an exploded view of the transfer being prepared for transferring.
Figure 2A:
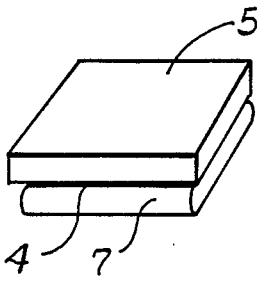
FIG. 2*a* shows the completion step of transferring.

As shows in the drawings, the method I have invented uses well known art and extends it inventively to a new and useful result. FIG. 1 consists entirely of steps well known to the art of making a certain kind of thermal transfer—a flat sheet of thin film on which colored wax has been deposited so as to make a full color image. Item 1 is a video camera with which an image of the object is converted to a record on magnetic tape, the record being formed or reproduced through scanning the picture area and recording the intensity of each color versus position. Item 2 is an image conditioner in which a single frame of the video tape is scanned repeatedly so as to produce commands for the printer, Item 3, color by color separately. Item 3 printer enlarges the output image as desired, and deposits tiny dots of wax in each of three primary colors successively on a thin flat sheet. The sheet and the wax-constituted image thereon are called a thermal transfer. Thermal transfer of this sort, made by this process, are widely used especially in the custom tee-shirt business. The name comes from the fact that the transfer, if heated while in contact with cloth or plastic, deposits its wax on the material with which it is in contact, transferring the image due to heat. Upon cooling, the film backing portion of the transfer is stripped away and discarded. The latter steps are shown in FIGS. 2 and 2*a* as modified by my concept of using flexible foam as the recipient material (rather than cloth) so as to recreate partially or wholly the depth dimension lost in the conventional process. The flat heated platen, Item 5, the transfer, Item 4, and all the items with smaller numbers are part of the existing art, as well as the colored wax, Item 8, shown in FIG. 2 as being on the transfer and in FIGS. 3 and 5 as being on the image portion of the product. Item 8 is not specifically designated in FIG. 4, since that figure emphasizes other features; and FIG. 6 is a blank Item 7 prior to the wax-transfer step.

Figure 3:
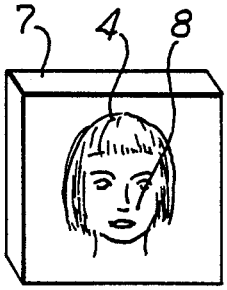
FIG. 3 shows the completed product in one form—a rectilinear block.

FIG. 3 shows a straight-forward flat image, differing only from the conventional practice in that flexible foam is the receiving material. The advantages of a product such as FIG. 3 over conventional photographs are its softness, which permits rough handling without the product sustaining or causing damage, and the fact that it is self-standing. The flexible foam block, Item 7, may be open-cell or closed-cell, though in the preferred embodiment it is an open-cell polyurethane foam.

Figure 4:
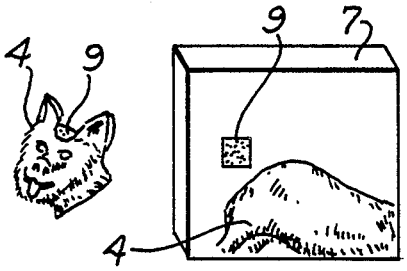
FIG. 4 shows the completed product in perspective when the product consists of two separable parts.

FIG. 4 shows a two-part product made by the novel method. The body of an animal or person is transferred to one block of foam, and in a spot behind the lower part of the head, adjacent to the neck portion of the body, a patch of hook-and-loop material, Item 9, is attached. The separable head, transferred to a second, thinner, block and trimmed, has a patch of mating hook-and-loop material attached to its back directly behind the neck portion. The composite assembly of the two blocks can then be made with a variety of tilt angles for the head, resulting in a somewhat three dimensional effect, plus a variety of appearances due to the variety of head-tilt angles.

Figure 5:
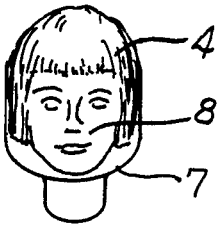
FIG. 5 shows a doll head in perspective, formed using the method.

FIG. 5 shows a doll head in which the face image is curved in one direction. This is accomplished by distorting the cylindrical surface of the foam blank into a plane, under the pressure applied to it by the platen, Item 5, during the time period when the image wax, Item 8, is being transferred from the transfer, Item 4, to the foam blank, Item 7.

A further curvature of the image, in a second dimension rectilinear to the curvature of the surface of a cylinder such as is shown as Item 7 in FIG. 2, can be obtained by contouring the surface of a cylindrical foam blank, similarly to that shown in FIG. 6. Indentations 6 may be formed or cut so as to provide more realism to the finished image by indenting the eyes and mouth, leaving the nose area full size. Obviously, as much sculpting of the cyindrical contour as is desired can be provided. The more sculpting, the more precision is required in causing transfer, Item 4, to register correctly on the sculpted surface. The reduced diameter at one end of the blanks in FIGS. 2, 5, and 6 is provided to engage a hole in the doll body at the neck.

The invention having been described in its preferred embodiment, it is clear that modifications are within the ability of those skilled in the art without exercise of the inventive faculty. Accordingly, the scope of the invention is defined in the scope of the following claims:

I claim:

1. A method of creating a colored image on flexible plastic foam, comprising:

recording the image on magnetic tape by conventional videotaping methods, and repeatedly scanning a single frame on a thermal transfer printer of the type in which wax is deposited on the surface of the flat transfer itself, and placing the transfer against a formed three dimensional flexible plastic foam surface and pressing said foam surface flat and heating said transfer to cause the wax to migrate to the foam, and stripping the backing from the transfer, whereby the colored image is created on the formed flexible plastic foam surface.

2. A method as in claim 1 further comprising distorting a cylindrical plastic foam surface into a plane at the time said heating step is transferring the image, whereby curvature in one direction will be imparted to the finished image.

3. A method as in claim 1 further comprising sculpting the plastic foam model so it curves in two orthogonal directions distorting said sculpted foam model into a plane at the time said heating step is transferring the image, whereby curvature in two directions is imparted to the finished image.

4. A doll's head having a face created from a two dimensional image of its owner's face, comprising:

a flexible foam plastic blank simulating a head, having the surfaces corresponding to the face three dimensional, and colored wax deposits thermally transferred to the surfaces of the face area of said flexible foam plastic blank by the method of claim 1.

* * * * *